US005437588A

United States Patent [19]

Abboudi et al.

[11] Patent Number: 5,437,588

[45] Date of Patent: Aug. 1, 1995

[54] MULTIFUNCTIONAL TREADMILL HAVING A SEAT

[76] Inventors: Shalom Y. Abboudi, 126 N. 9th Ave., Highland Park, N.J. 08904; Robert Adley, 18 Mendingwall Cir., Madison, Conn. 06443

[21] Appl. No.: 175,737

[22] Filed: Dec. 30, 1993

[51] Int. Cl.[6] ..... A63B 22/02

[52] U.S. Cl. ..... 482/54; 482/139

[58] Field of Search ..... 482/54, 51, 139

[56] References Cited

U.S. PATENT DOCUMENTS

| | | | |
|---|---|---|---|
| 1,611,807 | 12/1926 | Bergh | 482/69 X |
| 3,193,287 | 7/1965 | Robinson | 482/54 |
| 4,869,493 | 9/1989 | Johnston | 482/54 |
| 4,944,506 | 7/1990 | Keller et al. | 482/54 |
| 5,123,641 | 6/1992 | Abboudi et al. | 482/54 |
| 5,176,597 | 1/1993 | Bryne | 482/54 |

FOREIGN PATENT DOCUMENTS

| | | | |
|---|---|---|---|
| 8800850 | 2/1988 | WIPO | 482/54 |

*Primary Examiner*—Richard J. Apley
*Assistant Examiner*—Lynne A. Reichard
*Attorney, Agent, or Firm*—Henry I. Schanzer

[57] ABSTRACT

A treadmill for use within a pool of water for therapeutic exercise includes an endless track mounted between a pair of side members, a hand rail spaced above and extending parallel to one of the side members, and a vertical post secured to the one side member and providing support for the handrail. A seating member is mounted on the vertical post and is movable with respect to the post for selectively disposing the seating member at various heights above the one side member and either directly overlying the endless track or disposed to one side thereof.

10 Claims, 3 Drawing Sheets

MULTIFUNCTIONAL TREADMILL HAVING A SEAT

This invention relates to exercise apparatus and particularly to a treadmill type apparatus enabling the exercising of different muscles of a user's body depending upon how the apparatus is configured and used. In a preferred embodiment, the invention relates to a treadmill type apparatus for underwater use.

It is recognized that performing physical exercise while the body is at least partially submerged in a body of water provides a means for reducing unwanted levels of physical stress and impact, e.g., compressive forces across the spine and weight bearing joints. A low impact state is particularly important in the performance of therapeutic exercise programs by infirm, elderly, and obese persons.

U.S. Pat. No. 5,123,641 discloses a treadmill having an endless track on which a person can walk or jog while within a pool of water. For providing a variable resistance to movement of the track by the user's feet, one of the rollers supporting the track has an elongated axle which extends laterally beyond the track and the apparatus side frame and has a propeller mounted thereon. The supporting roller is frictionally engaged and rotated by the track upon movement of the track, thereby causing rotation of the propeller. The propeller rotation is resisted by the surrounding body of water which thus provides a resistance to movement of the track which is proportional to the speed of movement of the track. The subject matter of U.S. Pat. No. 5,123,641 is incorporated herein by reference.

In use, the exerciser stands on the treadmill track, engages with his hands the side rails or a front bar provided on the treadmill apparatus and, while his body is partially submerged and supported within a pool of water, walks or strides, etc. along the treadmill track. In treadmill walking exercise, the muscles exercised in the forward swing movement of the lower limb are the hip flexors and the quadriceps muscles. On the other hand, when the advancing foot makes contact with the belt of the treadmill and begins to pull the belt backwards, the main muscles which are activated are the gluteal and hamstring muscles in the back of the thighs.

There is a need, such as following knee injury or surgery, for exercising other muscles, such as the quadriceps muscles in the front of the thigh and, alternatively, the hamstring muscles, substantially independently of the gluteal muscles. Apparatus for exercising such other muscles (or individual muscles) is known and generally comprises apparatus specifically designed for exercising a particular set or sets of muscles.

It is desirable, for reasons of cost effectiveness and better utilization of space, that underwater exercise apparatus, suitable for exercising one set or sets of muscles, be usable for exercising a different set or sets of muscles normally only marginally exercised in the usual use of the apparatus. It is also desirable to perform the exercise utilizing the safe aquatic medium where the speed of movement determines the resistance and not a fixed resistance as encountered when lifting a weight on land. In particular, and in accordance with this invention, a treadmill of the type described above includes means whereby the unit treadmill can be used in conventional fashion by an exerciser standing upright for exercising the gluteal and hamstring muscles or, alternatively, while the exerciser is seated, to exercise the quadriceps muscles in the front of the thighs, or the hamstring muscles of the thighs with or without the gluteal muscles. This is further described hereinafter.

SUMMARY OF THE INVENTION

A treadmill apparatus comprises an endless track mounted for movement between a pair of side frame members and a horizontal seating member movably mounted for positioning the seating member between the two side members and directly over the movable track or positioned outside the side members and away from the movable track.

In use of the apparatus, an exerciser can either use the treadmill in conventional fashion, as by walking or jogging along the endless track, or by sitting on the seating member, the exerciser can use his or her feet to force the track either forwardly or rearwardly. In the seated position, different muscles or different combinations of muscles are exercised than those exercised in the upright position.

DESCRIPTION OF PREFERRED EMBODIMENT

Figure 1:
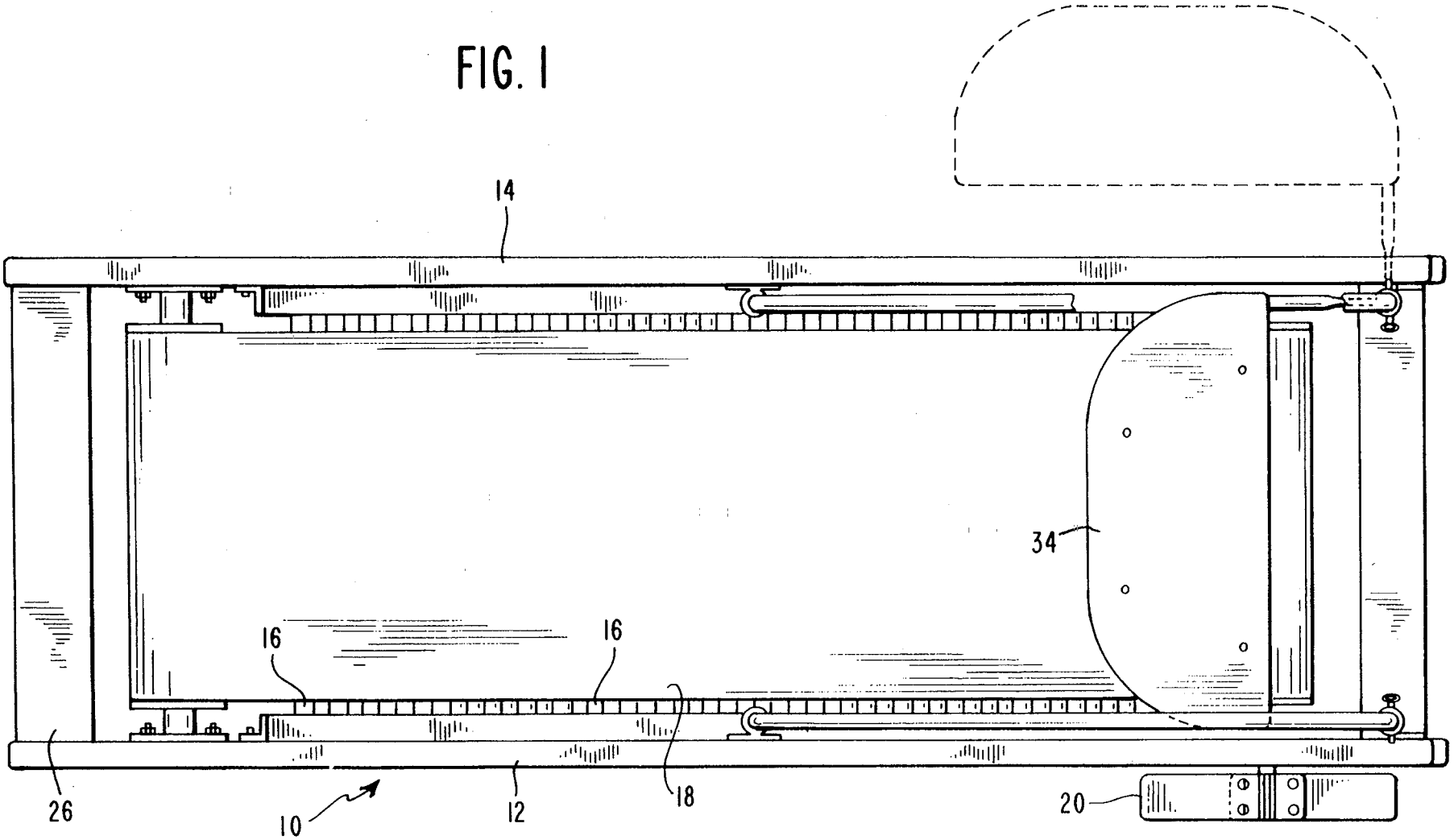
FIG. 1 is a plan view, partially broken away, of a treadmill apparatus according to the invention with the seating member shown, in solid lines, disposed directly over the movable track and shown, in dashed lines, rotated away from the track.

With reference to the drawings, the inventive apparatus comprises a treadmill 10 of the type shown in the aforementioned patent and includes a pair of side members 12 and 14 supporting therebetween a plurality of rollers 16 around which is mounted an endless track 18. One of the rollers 16, namely the end-most one at the right-hand end of the track {as shown in FIG. 1) has an elongated axle which extends beyond the side member 12 and has a propeller 20 mounted thereon. Movement of the propeller 20 within the body of water in which the apparatus is disposed is resisted by the water, and such resistance is coupled through the roller 16 on which the propeller is mounted to the track, thereby providing resistance to movement of the track by a user of the apparatus.

Figure 2:
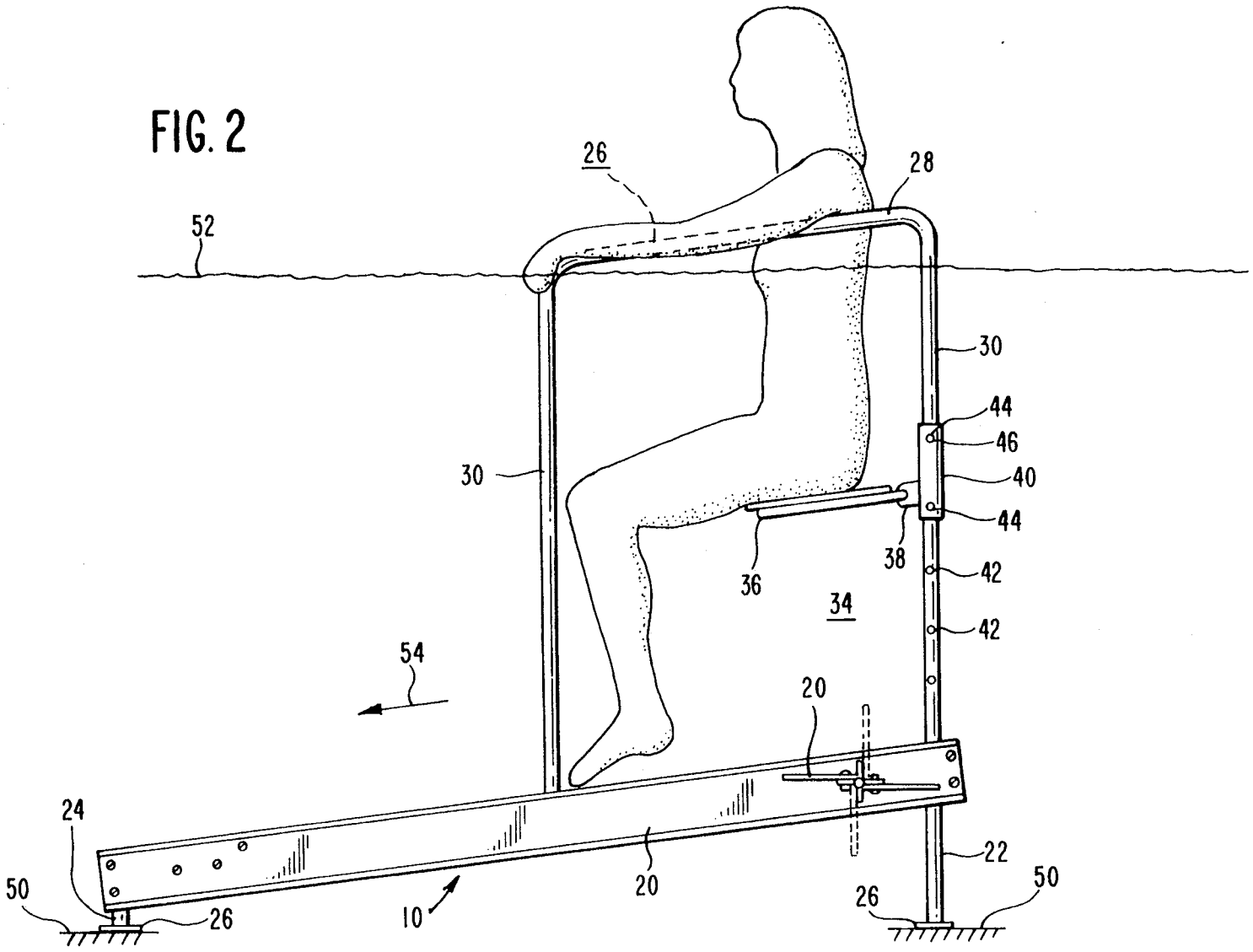
FIG. 2 is a side elevation of the apparatus and illustrating the use thereof.

As shown in FIG. 2, the side members 12 and 14 are supported on vertical legs 22 and 24, with the legs resting on flat plates 25 extending between pairs of legs at each end of the apparatus. As shown in FIG. 2, the right-hand legs 22 are longer than the left-hand legs 24 to dispose the side members 12 and 14 and the track at a slight incline to the horizontal to provide an up or down hill direction of movement of the track 18. Depending upon the direction of movement of the track, either end of the treadmill can be elevated above the opposite end.

The right-hand legs 22 are extensions of tubular posts which form hand rails 26 on each side of the apparatus. The hand rails comprise a horizontal section 28 extending between two vertical post sections 30 secured to the respective side members 12 and 14.

Mounted for relative movement on one of the vertical posts 30 is a seating member 34 which comprises a horizontal seat 36 secured by means of a pair of rods 38 and **38*a* each secured to a collar 40 and 40*a* mounted on a corresponding vertical post 30. The collars 40 and 40***a* are movable along the lengths of the posts 30.

Figure 3:
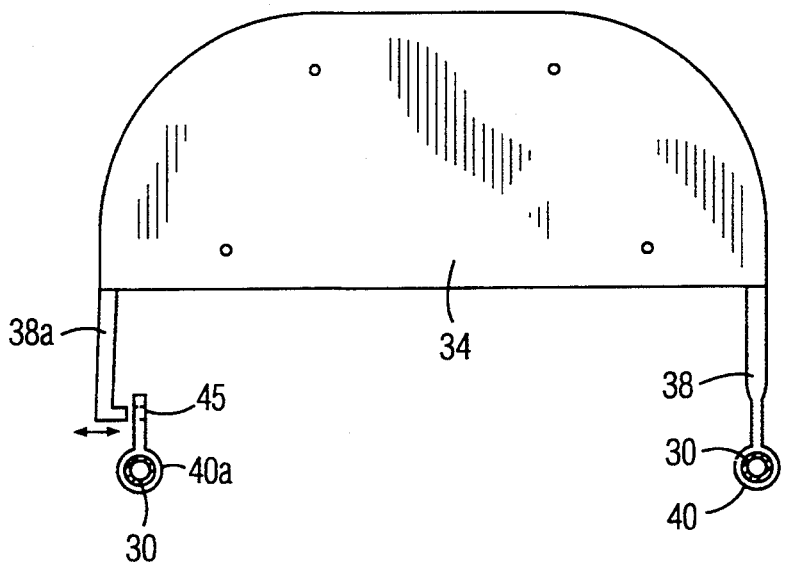
FIG. 3 is a plan view of the seating member and the rods used to secure the seating member to the frame.

Vertically spaced apart pairs of holes 42 are provided through the vertical posts 30, each pair of holes 42 being in horizontal alignment along a direction passing through the vertical axis of the post. The collars 40 and 40*a* have similar pairs of holes 44 through the walls thereof and pins 46 are provided which can be extended through the collar holes 44 and through corresponding aligned pairs of holes 42 through the vertical posts 30 for securing the vertical position of the seating member 34 relative to the vertical post 30. Also, the collar 40a (visible in FIG. 2) has a bracket 45 secured thereto, and the rod 38a has at the right-hand thereof, a transversely extending portion 48 (see FIG. 3) which extends removably via an opening through the bracket 45. Thus, the rod 38*a* can readily be detached from the collar 40*a*.

FIG. 1 shows, in solid lines, the seating member 34 secured to the posts 30 in a position between the two hand rails 26 and disposed directly over the track 18. FIG. 1 also shows, in dashed lines, the seating member 34 secured to the post 30 in a position outside of the hand rails 26 and away from the track 18.

The seating member 34 may be rotated about an upright 30 mounted on one side member (e.g., 12) and secured to the other upright 30 mounted on the other side member (e.g., 14) as shown in the Figures. It should be evident that many different means such as U-shaped members may be used to secure the seating member via an arm 38 to an upright. It should also be evident that the seating member 34 and the uprights may be constructed so as to enable the selective attachment and detachment of the seating member from the uprights.

FIG. 2 shows the seating member 34 at a selected height above the track. FIG. 2 also shows use of the apparatus by a person seated on the seat 36. In such use, the apparatus is disposed on the floor 50 of a pool of water 52 having a depth sufficient to substantially submerge most of the apparatus.

FIG. 2 shows a user facing downhill on the treadmill. One exercise performable in such position involves the user alternately thrusting his or her feet forwardly for advancing the track in the direction of the arrow 54. As described, resistance to track movement is provided by the propeller 20. The resistance is variable, depending upon the size of the propeller blades and the speed of the track movement and the corresponding speed of propeller rotation. Since the exerciser controls the speed of movement, the exerciser is able to control the intensity of the workout and minimize the chance of injury during exercise. Although FIGS. 1 and 2 show a propeller 20, for providing resistance, to track movement the propeller may not be necessary and alternatively, other means may be incorporated in the apparatus to provide increased resistance to motion.

Another advantage of the inventive apparatus is that since the user is both seated and substantially submerged in a water medium, the user's body is well supported, relaxed and unstressed except for the desired and selective exercising of the quadriceps muscles of the user's thighs.

Alternatively, while seated as shown in FIG. 2, the user can exercise the hamstring muscles of the thighs by pushing the track 18 in the direction opposite to that shown by the arrow 54, i.e., uphill.

By positioning the seating member outside the hand rails 26 and away from the track (dashed lines in FIG. 1), the treadmill 10 is useable by a standing individual as described in the aforecited U.S. Patent. Therefore, it is evident that a piece of equipment embodying the invention may be used as a conventional treadmill with the user standing upright or as a treadmill with the user seated. The same piece of equipment thus enables different types of exercise to be performed and different parts of the body to be exercised for increased fitness or for therapeutic treatment. Furthermore, equipment embodying the invention enables a more efficient use of the limited space normally available in a pool, since a single piece of equipment can be used to provide what would otherwise require two different pieces of equipment.

What is claimed is:

1. A treadmill exercise apparatus comprising a pair of spaced apart side members supporting an endless track therebetween, said track extending along the length of said side members between first and second ends thereof, a first vertical pole located along, and extending above, one of said side members; and a second vertical pole located along and extending above the other one of said side members; and a seat member; means rotatably mounting said seat member on said first vertical pole for selectively enabling said seat member to be rotated and support means located on said second vertical pole for securely engaging and firmly supporting said seat member when it is fully rotated and disposed directly over said track; said seat member when fully extended and rotated over said track for enabling a user of the treadmill exercise apparatus to sit on said seat member and, while seated, to either push or pull the track with the user's feet; said seat member being firmly supported and securely held in place on said first and second vertical poles wherein when a user sits on said seat member when it is fully rotated and engaged and either pushes or pulls the track with the user's feet there is no forward or rearward movement of said seat member and no sagging or tilting across the length of the seat member; and said seat member being rotatably mounted for selectively enabling the seat member to be rotated away from the track to enable a user to use the treadmill exercise apparatus while standing on the track.

2. A treadmill exercise apparatus as claimed in claim 1 in combination with a pool of water in which the apparatus is disposed.

3. An apparatus according to claim 1 including means for adjusting the position of said seat member vertically along said first and second vertical posts for adjusting the height of the seat member above said track and wherein the seat member is secured by means of a pair of rods extending beneath the ends of the seat member and secured to means mounted on corresponding ones of the vertical poles.

4. An apparatus according to claim 3 further including a side hand rail extending parallel to said side members.

5. A treadmill exercise apparatus comprising a pair of spaced apart side members supporting an endless track therebetween, said track extending along the length of said side members between first and second ends thereof, and including means for enabling a user of the treadmill facing said first end to walk on the endless track for causing the endless track to advance from said first end towards said second end;

a seat member; and means including first and second vertical poles located along opposite sides of said side members and extending above said members, and further including means for rotatably mounting said seat member on said first vertical pole and causing said seat member to be engaged and supported by said second vertical pole, said seat member being rotatably mounted on said first pole for selectively varying the position of said seat member between a first position disposed directly over said track and a second position disposed away from said track, whereby a user of the treadmill when seated on said seat member when the seat member is in said first position can advance the track in a first or second direction depending on the users' "pushing" or "pulling" with his feet, without the effect of the user's body weight; said seat member being firmly supported and securely held in place on said first and second vertical poles wherein when a user sits on said seat member when it is fully rotated and engaged and either pushes or pulls the track with the user's feet there is no forward or rearward movement of said seat member and no sagging or tilting across the length of the seat member.

6. A treadmill exercise apparatus as claimed in claim 5 in combination with a pool of water in which the apparatus is disposed.

7. A treadmill exercise apparatus as claimed in claim 5 wherein said first and second vertical poles are disposed near one of the ends of said side members.

8. A treadmill exercise apparatus as claimed in claim 7 wherein said vertical poles are mounted on said side members.

9. A treadmill exercise apparatus as claimed in claim 1 wherein said first and second vertical poles are disposed near one of the ends of said side members.

10. A treadmill exercise apparatus as claimed in claim 9 wherein said vertical poles are mounted on said side members.

* * * * *